US005258278A

United States Patent [19]

Merkel et al.

[11] Patent Number: 5,258,278

[45] Date of Patent: Nov. 2, 1993

[54] COLOR PHOTOGRAPHIC MATERIAL CONTAINING A COUPLER COMPOSITION COMPRISING A PYRAZOLDTRIAZOLE MAGENTA COUPLER AND A CARBONAMIDE COMPOUND

[75] Inventors: Paul P. Merkel, Rochester; Edward Schofield, Penfield, both of N.Y.

[73] Assignee: Eastman Kodak Company, Rochester, N.Y.

[21] Appl. No.: 731,221

[22] Filed: Jul. 15, 1991

[51] Int. Cl.[5] ..... G03C 1/08; G03C 7/26; G03C 7/32

[52] U.S. Cl. ..... 430/546; 430/558; 430/551; 430/372

[58] Field of Search ..... 430/555, 546, 558, 372, 430/55

[56] References Cited

U.S. PATENT DOCUMENTS

| | | | |
|---|---|---|---|
| 3,764,336 | 10/1973 | Nittel et al. | 430/449 |
| 4,171,975 | 10/1979 | Kato et al. | 430/554 |
| 4,250,251 | 2/1981 | Osborn et al. | 430/449 |
| 4,522,917 | 6/1985 | Ichijima et al. | 430/562 |
| 4,540,654 | 9/1985 | Sato et al. | 430/381 |
| 4,840,878 | 6/1989 | Hirose et al. | 430/380 |
| 4,857,449 | 8/1989 | Ogawa et al. | 430/546 |
| 4,865,963 | 9/1989 | Furutachi et al. | 430/558 |
| 4,900,655 | 2/1990 | Nakazyo et al. | 430/546 |

FOREIGN PATENT DOCUMENTS

| | | |
|---|---|---|
| 0217353 | 4/1987 | European Pat. Off. . |
| 0286431 | 10/1988 | European Pat. Off. . |
| 0309160 | 3/1989 | European Pat. Off. . |
| 2805706 | 3/1992 | European Pat. Off. . |
| 3730557 | 3/1989 | Fed. Rep. of Germany . |
| 225240 | 7/1985 | German Democratic Rep. . |
| 486929 | 5/1992 | Japan . |

*Primary Examiner*—Charles L. Bowers, Jr.
*Assistant Examiner*—Geraldine Letscher
*Attorney, Agent, or Firm*—Lowe, Price, LeBlanc & Becker

[57] ABSTRACT

Photographic coupler compositions comprise a pyrazolotriazole magenta dye-forming coupler and an performance-improving amount of a carbonamide compound. Improved performance is indicated by increased photographic speed, improved light stability of the resulting magenta dye and/or desired hypsochromic hue shifts in the resulting magenta dye. Color photographic materials and methods employ the coupler compositions.

19 Claims, No Drawings

COLOR PHOTOGRAPHIC MATERIAL CONTAINING A COUPLER COMPOSITION COMPRISING A PYRAZOLDTRIAZOLE MAGENTA COUPLER AND A CARBONAMIDE COMPOUND

FIELD OF THE INVENTION

The present invention relates to photographic coupler compositions which comprise a pyrazolotriazole magenta dye-forming coupler and a carbonamide compound which improves the performance of the coupler. The invention also relates to color photographic materials including such coupler compositions, methods for improving the performance of pyrazolotriazole magenta dye-forming coupler compounds, and methods for the formation of color images.

BACKGROUND OF THE INVENTION

It is well known in the color photography art that color images are produced by a colored dye which is formed by a coupling reaction between an oxidized product of an aromatic primary amine color developing agent and a coupler. Various types of cyan, magenta and yellow dye-forming couplers are well known for use in such coupling reactions. The couplers are often used in combination with one or more solvents and/or other additives. High-boiling solvents which are known for use in combination with couplers include those referred to in Research Disclosure, Item 308119, December 1989.

It is often desirable in color photography to provide the coupler compounds with improved performance wherein improved performance is indicated by an increase in photographic speed when the coupler compound is employed in a silver halide emulsion color photography process, improvement in the light stability of the resulting dye and/or production of a hypsochromic hue shift in the resulting dye, or the like. For example, the Sato et al European Patent Application No. 286,431 discloses the use of pyrazolotriazole magenta dye-forming couplers in combination with phosphonates and phosphine oxide compounds in order to achieve improved dye light stability and improved dye hue. The Kato et al U.S. Pat. No. 4,171,975 discloses the use of bis-pyrazolone magenta dye-forming coupler compounds in combination with carbonamide compounds in order to achieve improved color density, developing speed, processing stability and light stability. The Nakazyo et al U.S. Pat. No. 4,900,655 discloses the use of additional magenta coupler compounds with various coupler solvents including, among others, carbonamides. The Kozo et al U.S. Pat. No. 4,840,878 discloses the use of various high boiling solvents including, among others, carbonamides, in combination with coupler compounds in short-time development processes. The short-time development processes generally take no more than 2.5 minutes, employ a reflective support and are conducted without the use of benzyl alcohol. The Furutachi et al U.S. Pat. No. 4,865,963 discloses silver halide color photographic materials comprising a pyrazoloazole series magenta coupler which is used in combination with a high boiling point organic solvent and an ultraviolet absorbent to improve light fastness and coloring.

Many coupler compositions, however, are disadvantageous in that relatively large amounts of a coupler are required to provide satisfactory color density, the reaction rate of the coupler with the oxidized developer is undesirably low, the colored image which is formed from the reaction of the coupler compound with the oxidized developer exhibits unacceptable light instability, the hue of the dye resulting from coupling is unfavorable and/or the like. It is also known that pyrazolotriazoles often exhibit speed losses in photographic systems. Accordingly, a continuing desire exists for coupler compositions of improved properties for use in color photographic materials and methods.

SUMMARY OF THE INVENTION

Accordingly, it is an object of the present invention to provide novel coupler compositions for use in color photography. It is a further object of the invention to provide coupler compositions which exhibit improved coupler performance as indicated by an increase in photographic speed when the compositions are employed in a silver halide emulsion color photography process, improved light stability of color images formed by reaction of the coupler composition with an oxidized developer, and/or desirable hypsochromic shifts in the formed dye hues. It is a related object of the invention to provide methods for improving the performance of certain magenta dye-forming couplers in a color photographic development process. Additional objects of the invention include the provision of improved color photographic materials and improved methods for the formation of color images.

These and additional objects are provided by the photographic coupler compositions, the color photographic materials and the methods according to the present invention. The photographic coupler compositions according to the present invention comprise a pyrazolotriazole magenta dye-forming coupler of the formula

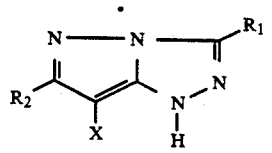

(I)

wherein $R_1$ and $R_2$ are individually selected from the group consisting of hydrogen, substituted and unsubstituted alkyl, substituted and unsubstituted phenyl, substituted and unsubstituted alkoxy, substituted and unsubstituted aryloxy, substituted and unsubstituted amino, substituted and unsubstituted anilino, substituted and unsubstituted acylamino, halogens and a group which links to a polymer, provided that the total number of carbon atoms contained in $R_1$ and $R_2$ is at least 10 if neither $R_1$ nor $R_2$ is a group which links to a polymer; and X is hydrogen or a coupling-off group selected from the group consisting of halogens, alkoxy, aryloxy, alkylthio, arylthio, acyloxy, sulfonamido, carbonamido, arylazo, nitrogen-containing heterocyclic and imido groups. When at least $R_1$ or $R_2$ is a group which links to a polymer, the coupler is a polymer containing substituents of formula (I) set forth above.

The carbonamide compound which is included in the coupler compositions of the present invention is of the formula

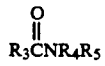

(II)

wherein $R_3$, $R_4$ and $R_5$ are individually selected from the group consisting of straight and branched chain alkyl groups, alkenyl groups and alkylene groups; straight and branched chain alkyl groups, alkenyl groups and alkylene groups containing at least one substituent selected from the group consisting of alkoxy, aryloxy, aryl, alkoxycarbonyl, aryloxycarbonyl and acyloxy; a phenyl group; and a phenyl group containing at least one substituent selected from the group consisting of alkyl, alkoxy, aryloxy, aryl, alkoxycarbonyl, aryloxycarbonyl and acyloxy; and wherein $R_3$, $R_4$ and $R_5$ combined contain at least 12 carbon atoms. It has been discovered that the carbonamide compounds surprisingly provide improved performance to the pyrazolotriazole couplers as indicated by increased photographic speeds when the coupler compositions are employed in silver halide emulsion color photography processes, improved light stability of the magenta dyes formed from the couplers and desirable hypsochromic hue shifts in the magenta dyes formed from the couplers. The coupler compositions of the present invention are therefore suitable for use in improved silver halide color photographic materials and in improved methods for the formation of color images.

These and additional objects and advantages will be more fully apparent in view of the following detailed description.

DETAILED DESCRIPTION

The photographic coupler compositions according to the present invention comprise a pyrazolotriazole magenta dye-forming couplers and a carbonamide compound in an amount sufficient to improve the performance of the coupler. In the present specification and claims, improvement in the performance of the coupler is indicated by an increase in photographic speed when the coupler compositions are employed in a silver halide emulsion color photography process, an improvement in the light stability of the magenta dyes formed from the couplers and/or the provision of hypsochromic hue shifts in the magenta dyes formed from the couplers. These features provide improved color photographic materials when the coupler compositions of the present invention are included therein.

The magenta dye-forming couplers employed in the compositions of the present invention comprise pyrazolotriazoles of the general Formula I:

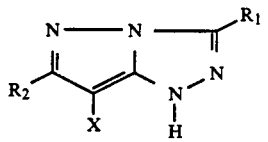

(I)

wherein $R_1$ and $R_2$ are individually selected from the group consisting of hydrogen, substituted and unsubstituted alkyl, substituted and unsubstituted phenyl, substituted and unsubstituted alkoxy, substituted and unsubstituted aryloxy, substituted and unsubstituted amino, substituted and unsubstituted anilino, substituted and unsubstituted acylamino, halogens and a group which links to a polymer, provided that the total number of carbon atoms contained in $R_1$ and $R_2$ is at least 10 if neither $R_1$ nor $R_2$ is a group which links to a polymer; and X is hydrogen or a coupling-off group selected from the group consisting of halogens, alkoxy, aryloxy, alkylthio, arylthio, acyloxy, sulfonamido, carbonamido, arylazo, nitrogen-containing heterocyclic and imido groups. When at least one of $R_1$ and $R_2$ is a group which links to a polymer, the coupler is a polymer containing substituents of the formula (I).

In a preferred embodiment, $R_1$ and $R_2$ are individually selected from the group consisting of alkyl, substituted alkyl, phenyl and substituted phenyl groups. Suitable substituents for the alkyl and phenyl groups include, among others, carbonamido, carbamoyl, phenyl, hydroxyphenyl, sulfonamidophenyl, sulfamoylphenyl, carbonamidophenyl and carboxyphenyl groups. These groups themselves may also be substituted, if desired. It is preferred, however, that $R_1$ and $R_2$ are not alkyl groups which are directly substituted with sulfonamido or sulfamoyl groups.

Coupling-off groups are well known to those skilled in the photographic art. Generally, such groups determine the equivalency of the coupler and modify the reactivity of the coupler. Coupling-off groups can also advantageously effect the layer in which the coupler is coated or other layers in the photographic material by performing, after release from the coupler, such functions as development inhibition, bleach acceleration, color correction, development acceleration and the like. Representative coupling-off groups include, as noted above, halogens (for example, chloro), alkoxy, aryloxy, alkylthio, arylthio, acyloxy, sulfonamido, carbonamido, arylazo, nitrogen-containing heterocyclic groups such as pyrazolyl and imidazolyl, and imido groups such as succinimido and hydantoinyl groups. Except for the halogens, these groups may be substituted if desired. Coupling-off groups are described in further detail in: U.S. Pat. Nos. 2,355,169; 3,227,551; 3,432,521; 3,476,563; 3,617,291; 3,880,661; 4,052,212 and 4,134,766, and in British Patent References Nos. 1,466,728; 1,531,927; 1,533,039; 2,006,755A and 2,017,704A, the disclosures of which are incorporated herein by reference.

As is well known in the photographic art, a coupler should be nondiffusible when incorporated in a photographic element. That is, the coupler should be of such a molecular size and configuration that it will exhibit substantially no diffusion from the layer in which it is coated. To achieve this result, the total number of carbon atoms contained in $R_1$ and $R_2$ combined should be at least 10. Preferably, $R_1$ and $R_2$ combined contain from 10 to about 40 carbon atoms. Alternatively, $R_1$ or $R_2$ may serve as a link to or form part of a polymeric chain.

In preferred embodiments of the magenta dye-forming coupler of Formula (I), X is a halogen atom, most preferably chlorine, $R_2$ is an alkyl group, and/or the total number of carbon atoms contained in $R_1$ and $R_2$ is from 10 to about 40.

Suitable pyrazolotriazole magenta dye-forming couplers for use in the compositions and methods of the present invention include, but are not limited to, the following (m-i)-(m-x):

(m-i)
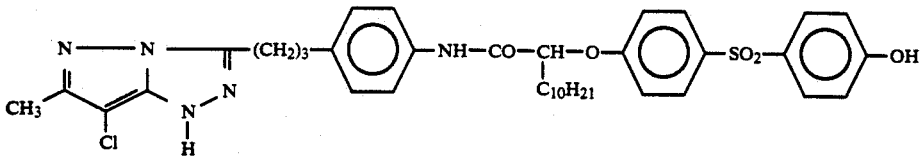
(mii)
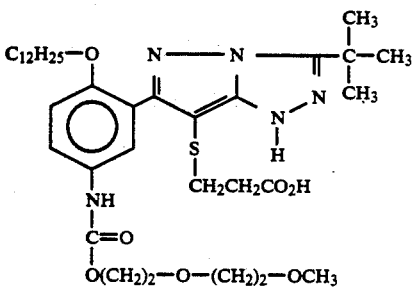
(m-iii)
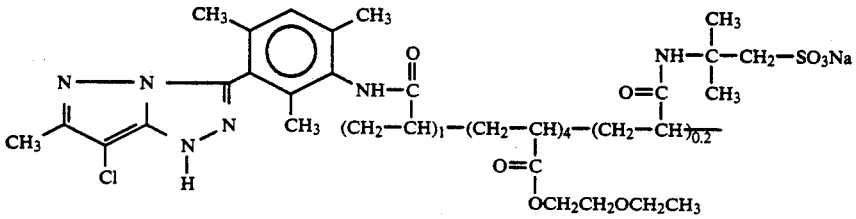
(m-iv)
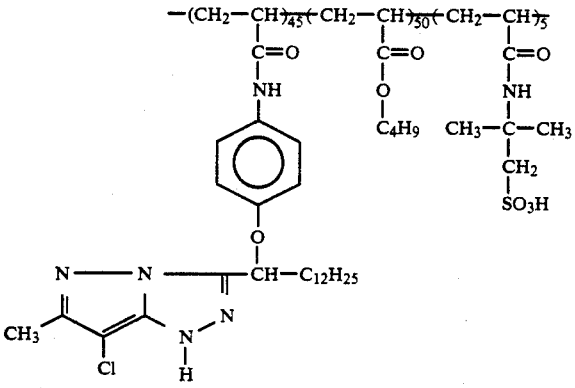
(m-v)
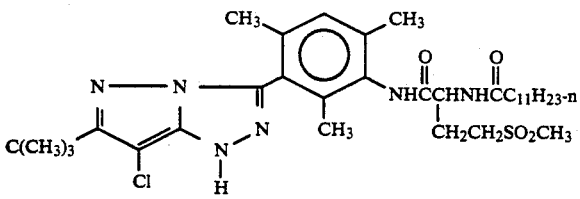
(m-vi)
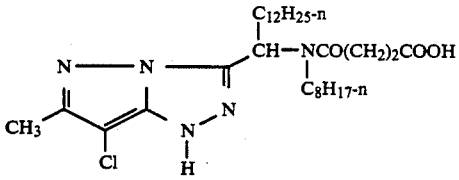
(m-vii)
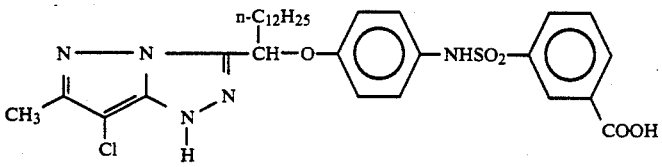

-continued

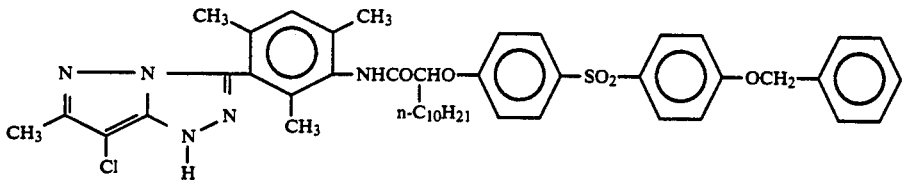

(m-viii)

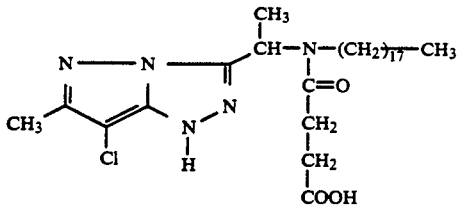

(m-ix)

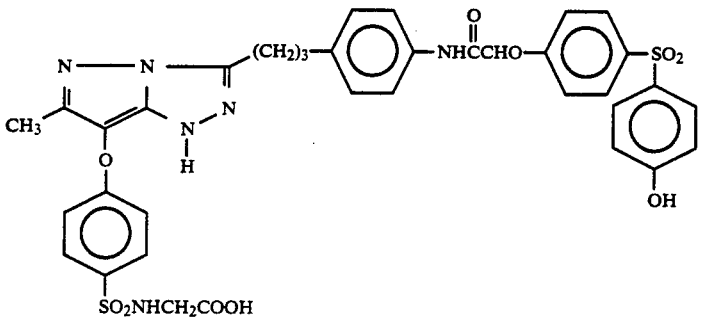

(m-x)

The carbonamide compounds which are included in the coupler compositions of the present invention may act as a solvent for the dye-forming coupler. The carbonamide compounds are ballasted in order to minimize volatility, water solubility and diffusivity. The carbonamide compounds are of the following Formula (II):

$$R_3\overset{\overset{\displaystyle O}{\|}}{C}NR_4R_5 \qquad \text{(II)}$$

wherein $R_3$, $R_4$ and $R_5$ are individually selected from the group consisting of straight and branched chain alkyl groups, alkenyl groups and alkylene groups; straight and branched chain alkyl groups, alkenyl groups and alkylene groups containing at least one substituent selected from the group consisting of alkoxy, aryloxy, aryl, alkoxycarbonyl, aryloxycarbonyl and acyloxy; a phenyl group; and a phenyl group containing at least one substituent selected from the group consisting of alkyl, alkoxy, aryloxy, aryl, alkoxycarbonyl, aryloxycarbonyl and acyloxy; and wherein $R_3$, $R_4$ and $R_5$ combined contain at least 12 carbon atoms. More preferably, $R_3$, $R_4$ and $R_5$ contain from about 15 to about 30 carbon atoms in order to minimize volatility, water solubility and diffusivity. In one embodiment, $R_3$ and $R_4$ or $R_4$ and $R_5$ may be joined, thereby forming a ring. For example, $R_3$ and $R_4$ may join to form a 5-membered pyrrolidinone ring.

In preferred embodiments, $R_3$ is selected from the group consisting of straight and branched chain alkyl and alkenyl groups, preferably of from 1 to about 20 carbon atoms or $R_3$ comprises an aryl-substituted alkyl group. In additionally preferred embodiments, $R_4$ and $R_5$ are individually selected from the group consisting of straight and branched chain, phenyl-substituted and unsubstituted alkyl groups, preferably of from 1 to about 20 carbon atoms, with $R_4$ and $R_5$ being the same or different groups.

Suitable carbonamide compounds for use in the compositions and method of the present invention include, but are not limited to, the following compounds (C-I)-(C-XX):

$$n\text{-}C_{11}H_{23}\overset{\overset{\displaystyle O}{\|}}{C}N(C_2H_5)_2 \qquad \text{(C-I)}$$

$$n\text{-}C_{11}H_{23}\overset{\overset{\displaystyle O}{\|}}{C}N(C_3H_7\text{-}n)_2 \qquad \text{(C-II)}$$

$$n\text{-}C_{13}H_{27}\overset{\overset{\displaystyle O}{\|}}{C}N(CH_3)_2 \qquad \text{(C-III)}$$

$$n\text{-}C_8H_{11}CH{=}CH(CH_2)_7\overset{\overset{\displaystyle O}{\|}}{C}N(CH_3)_2 \qquad \text{(C-IV)}$$

$$n\text{-}C_{11}H_{23}\overset{\overset{\displaystyle O}{\|}}{C}N(C_4H_9\text{-}n)_2 \qquad \text{(C-V)}$$

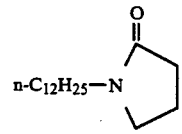

(C-VI)

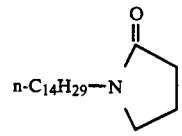

(C-VII)

-continued (C-VIII)

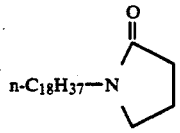

(C-IX)

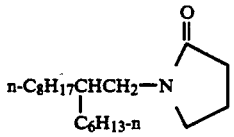

(C-X)

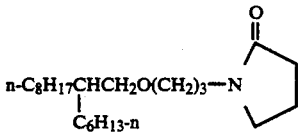

(C-XI)

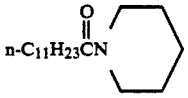

(C-XII)

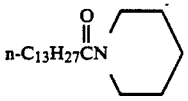

(C-XIII)

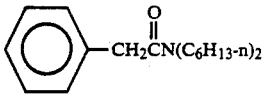

(C-XIV)

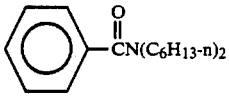

(C-XV)

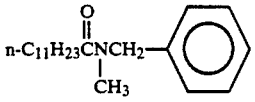

(C-XVI)

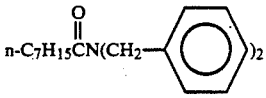

(C-XVII)

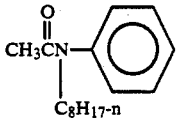

(C-XVIII)

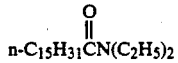

(C-XIX)

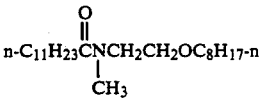

(C-XIX)

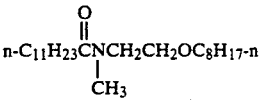

-continued (C-XX)

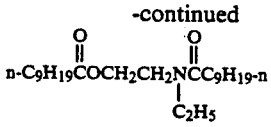

As noted above, the carbonamide compounds employed in the coupler compositions of the present invention may act as a solvent for the dye-forming coupler. One or more additional organic solvents for the coupler compound may also be employed in the compositions of the present invention. Generally, conventional organic coupler solvents are known in the art and may be employed when the carbonamide compounds of the present invention are used in an additive amount which is not sufficient to result in a solution of the coupler compound. Examples of conventional organic solvents which may be used in the present compositions are described in the Examples set forth below.

The carbonamide compounds are employed in the coupler compositions of the present invention in an amount sufficient to improve the performance of the magenta dye-forming coupler. In most applications, it is preferred that the dye-forming coupler and the carbonamide compound are employed in a weight ratio of from about 1:0.1 to about 1:10 in order to effect an increase in the aforementioned coupler performance.

The photographic coupler compositions according to the present invention are employed in color photographic materials in a manner well known in the color photographic art. For example, a supporting substrate may be coated with a silver halide emulsion and the coupler composition of the present invention comprising a magenta dye-forming coupler and a carbonamide compound in an amount sufficient to improve the performance of the magenta dye-forming coupler. The photographic material may then be imagewise exposed in a manner well known in the color photography art, followed by development with an aromatic primary amine developer. As is further well known in the art, the oxidation product of the aromatic primary amine developer reacts with the coupler compound to form the colored dye images. In a preferred embodiment, the compositions of the present invention are employed in color image formation methods in which the development step is conducted for at least 3 minutes.

Photographic elements in which the compositions of this invention are incorporated can be simple elements or multilayer, multicolor elements. The compositions of this invention can be incorporated into layers containing silver halide emulsions of a variety of types known in the art, such as fine or course grain emulsions, tabular grain emulsions, silver chlorobromide and silver bromoiodide emulsions. Useful tabular grain emulsions are described in *Research Disclosure,* Item 22534, January 1983 and in U.S. Pat. No. 4,748,106, incorporated herein by reference. The layers in which the compositions of this invention are incorporated may also contain other coupler components, such as colored masking couplers, image-modifying couplers (DIRs or DIARs as disclosed in U.S. Pat. Nos. 3,148,062, 3,227,554 3,733,201, 4,409,323 and 4,248,962) and bleach accelerator-releasing couplers (BARCs as disclosed in EP 193,389). In a preferred embodiment, the color photographic material comprises a transparent substrate coated with a silver halide emulsion and the coupler composition.

The coupler compositions according to the present invention may further include conventional additives, including certain light stabilizers such as phenols, alkoxybenzene derivatives, anilines, oxyanilines and the like, if desired.

The compositions and methods of the present invention are demonstrated by the following examples in which references are to parts by weight unless otherwise specified. Reference to standard coupler solvents S1 and S2 refers to conventional coupler solvents comprising mixed tritolyl phosphates and dibutyl phthalate, respectively.

EXAMPLE 1

Coupler compositions comprising emulsion dispersions of the coupler compound (m-i) as set forth above were prepared using carbonamide compounds (C-I)-(C-IV) according to the present invention as solvents and using conventional coupler solvents S1 and S2 for comparison purposes as set forth in Table I. Specifically, an oil phase was prepared by warming a mixture of 3.4 g of coupler compound (m-i), 1.7 g of the respective coupler solvent and 10.2 g of an auxiliary solvent comprising 2-(2-butoxyethoxy) ethyl acetate until dissolution was complete. The weight ratio of coupler compound to the non-auxiliary solvent was 1:0.5. The resulting solution was added to an aqueous solution containing 18.13 g of a 12.5 weight percent aqueous gelatin, 2.27 g of a 10% aqueous Alkanol XC solution and 2.08 g of water. The resulting mixture was then passed through a colloid mill three times to disperse the oil phase and the resulting dispersion was chilled, noodled and washed for four hours at 40° C. to remove the auxiliary solvent. The resulting dispersed coupler composition was then coated on a cellulose acetate butyrate support at a level of $1.5\times10^{-4}$ moles/ft$^2$ (108 mg/ft$^2$) together with a sensitized silver bromoiodide emulsion (approximately 0.55$\mu$, 12% iodide) in the following format:

| | | |
|---|---|---|
| Gelatin | 250 | mg/ft$^2$ |
| Hardener | 1.75% | of total gel |
| Gelatin | 350 | mg/ft$^2$ |
| Coupler (m-i) | $1.5\times10^{-4}$ | mole/ft$^2$ |
| Coupler Solvent | 1:0.5 | (w/w) |
| Silver Halide Emulsion | 84.2 | mg/ft$^2$ Ag |
| Tetraazaindine | 1.75 | g/mole Ag |
| | Support | |

Hardened film strips of the resulting product were exposed (1/25 sec, 1B sensitometer) through a step tablet and then subjected to the Kodak Flexicolor ® commercial development process. The status M green densities of the processed films were measured both before and after exposure to one week of unfiltered 5.4 Klux daylight irradiation. A percent fade was determined by comparing the status M green densities after irradiation to those before irradiation at an initial density of approximately 1.0. The percent fade values are set forth in Table I. Also set forth in Table I are values of the wavelength of maximum absorption (λmax) which were measured on a spectrophotometer. As shown in Table I, the coupler solvents were evaluated in two separate coating sets, A and B.

TABLE I

| | Coupler Solvent | % Fade | λmax (nm) |
|---|---|---|---|
| Set A: | S1 | 40 | 555 |
| | S2 | 46 | 556 |
| | C-II | 35 | 554 |
| Set B: | S1 | 44 | 554 |
| | S2 | 42 | 555 |
| | C-I | 37 | 552 |
| | C-II | 36 | 552 |
| | C-III | 36 | 553 |
| | C-IV | 34 | 553 |

The results set forth in Table I demonstrate that the coupler compositions according to the present invention containing a carbonamide compound in combination with the magenta dye-forming coupler provided a color image which exhibited improved light stability, as indicated by a reduced percent fade, as compared with that formed from the compositions containing the conventional coupler solvents. In addition, the color images formed from the coupler compositions according to the present invention exhibited slight but desirable hypsochromic shifts in dye hue. These shifts can lessen unwanted absorption of red light by the magenta dye.

EXAMPLE 2

In this example, coupler compositions comprising emulsion dispersions of the polymeric coupler (m-iii) as set forth above were prepared using a carbonamide compound according to the present invention and using conventional coupler solvents for comparison purposes as described in Table II. Specifically, dispersions of the coupler compound were prepared by milling 3.0 g of the respective coupler solvent and 1.1 g of ethylacetate with 15 ml of a 12.5% aqueous gelatin, 1.9 ml of a 10% aqueous Alkanol XC solution and 9.1 ml of water. Each of the respective coupler solvent dispersions were combined with a latex dispersion of the coupler (m-iii) to provide a weight ratio of coupler to solvent of 1:0.5. The resulting mixture was stirred for three hours at 40° C. to permit loading of the coupler solvent into the latex. The coupler solvent-loaded latex dispersions of polymeric coupler compound (m-iii) were coated at a level of $1.5\times10^{-4}$ moles/ft$^2$ together with the silver bromoiodide emulsion described in Example 1 in the following format:

| | | |
|---|---|---|
| Gelatin | 250 | mg/ft$^2$ |
| Hardener | 1.75% | of total gel |
| Gelatin | 350 | mg/ft$^2$ |
| Coupler (m-iii) | $1.5\times10^{-4}$ | mole/ft$^2$ |
| Coupler Solvent | 1:0.5 | (w/w) |
| Silver Halide Emulsion | 84.2 | mg/ft$^2$ Ag |
| Tetraazaindine | 1.75 | g/mole Ag |
| | Support | |

Hardened film samples of the resulting product were processed in accordance with the procedures in Example 1. The percent fade and λmax for each sample were also determined in accordance with the procedures described in Example 1. The results of these measurements are set forth in Table II.

TABLE II

| Coupler Solvent | % Fade | λmax (nm) |
|---|---|---|
| S1 | 47.5 | 559 |
| S2 | 54.1 | 559 |
| C-II | 40.0 | 557 |

The results set forth in Table II demonstrate that the coupler composition according to the present invention containing a carbonamide compound produced a magenta color image exhibiting improved light stability as compared with the color images formed from the coupler compositions containing the conventional coupled solvents. The magenta color image produced from the coupler composition according to the present invention also exhibited a desirable hypsochromic hue shift.

EXAMPLE 3

This example demonstrates the improvements in photographic speed provided by the coupler compositions of the present invention in a photographic developing process. The photographic speed was measured as the KIT speed, the Kontrast Independent Toe speed, a property which is known in the art and which is defined as the exposure where the density above Dmin is 0.20 times the average gradient from that point to 0.6 logE greater exposure. In forming color images, the dispersion, coating and processing procedures set forth in Example 1 were followed in preparing film strips from coupler compositions containing carbonamide compound C-I and the conventional coupler solvents S1 and S2, respectively. The status M green densities were measured as a function of exposure and the KIT speeds were determined in accordance with the aforementioned definition. The KIT speed values are set forth in Table III. The listed values represent an average of four separate determinations and have a standard deviation of 0.005 units.

TABLE III

| Coupler Solvent | KIT Speed (log E) |
|---|---|
| S1 | 2.425 |
| S2 | 2.415 |
| C-I | 2.488 |

The results set forth in Table III demonstrate that the coupler composition according to the present invention exhibited in increased KIT speed of 0.07 log E units, which signifies a significant improvement in photographic speed, as compared with the conventional compositions.

The preceding examples are set forth to illustrate specific embodiments of the invention and are not intended to limit the scope of the compositions, materials and methods of the present invention. Additional embodiments and advantages within the scope of the claimed invention will be apparent to one of ordinary skill in the art.

What is claimed is:

1. A color photographic material, comprising a supporting substrate bearing a silver halide emulsion and a coupler composition comprising (a) a pyrazolotriazole magenta dye-forming coupler, and (b) a carbonamide compound in an amount sufficient to improve the performance of the coupler, the pyrazolotriazole magenta dye-forming coupler being of the formula

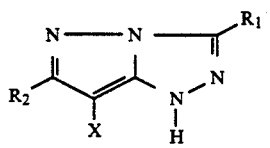

wherein $R_1$ and $R_2$ are individually selected from the group consisting of hydrogen, substituted and unsubstituted alkyl, substituted and unsubstituted phenyl, substituted and unsubstituted alkoxy, substituted and unsubstituted aryloxy, substituted and unsubstituted amino, substituted and unsubstituted aniline, substituted and unsubstituted acylamino, halogens and a group which links to a polymer, provided that the total number of carbon atoms contained in $R_1$ and $R_2$ is at least 10 if neither $R_1$ nor $R_2$ is a group which links to a polymer and provided that neither $R_1$ nor $R_2$ is an alkyl group directly substituted with a sulfonamido or a sulfamoyl group; and X is hydrogen or a coupling-off group selected from the group consisting of halogens, alkoxy, aryloxy, alkylthio, arylthio, acyloxy, sulfonamido, carbonamido, arylazo, nitrogen-containing heterocyclic and imido groups; and the carbonamide compound being of the formula $$R_3\overset{\overset{\displaystyle O}{\|}}{C}NR_4R_5$$

wherein $R_3$ is selected from the group consisting of straight and branched chain alkyl groups, alkenyl groups and alkylene groups; straight and branched chain alkyl groups, alkenyl groups and alkylene groups containing at least one substituent selected from the group consisting of alkoxy, aryloxy, aryl, alkoxycarbonyl, aryloxycarbonyl and acyloxy; a phenyl group; and a phenyl group containing at least one substituent selected from the group consisting of alkyl, alkoxy, aryloxy, aryl, alkoxycarbonyl, aryloxycarbonyl and acyloxy; and $R_4$ and $R_5$ are individually selected from the group consisting of straight and branched chain alkyl groups, alkenyl groups and alkylene groups; and straight and branched chain alkyl groups, alkenyl groups and alkylene groups containing at least one substituent selected from the group consisting of alkoxy, aryloxy, aryl, alkoxycarbonyl, aryloxycarbonyl and acyloxy; and wherein $R_3$, $R_4$ and $R_5$ combined contain at least 12 carbon atoms.

2. A color photographic material as defined by claim 1, wherein the carbonamide compound is included in an amount sufficient to improve the light stability, of a magenta dye formed form the pyrazolotriazole magenta dye-forming coupler.

3. A color photographic material as defined by claim 1, wherein the carbonamide compound is included in an amount sufficient to produce a hypsochromic hue shift in a magenta dye formed from the pyrazolotriazole magenta dye-forming coupler.

4. A color photographic material as defined by claim 1, wherein the carbonamide compound is included in an amount sufficient to increase photographic speed when the photographic coupler composition is employed in a silver halide emulsion color photography process.

5. A color photographic material as defined by claim 1, wherein the magenta dye-forming coupler and the carbonamide compound are included in a weight ratio of from about 1:0.1 to about 1:10.

6. A color photographic material as defined by claim 1, wherein $R_1$ and $R_2$ are individually selected from the group consisting of alkyl, substituted alkyl, phenyl and substituted phenyl group.

7. A color photographic material as defined by claim 6, wherein the alkyl and phenyl substituents are selected from carbonamido, carbamoyl, alkoxy, aryloxy, carboxylphenyl, hydroxyphenyl, sulfonamidophenyl, sulfamoylphenyl, carbonamidophenyl and carboxyphenyl groups.

8. A color photographic material as defined by claim 6, wherein $R_2$ is an alkyl group.

9. A color photographic material as defined by claim 1, wherein the total number of carbon atoms contained in $R_1$ and $R_2$ is from 10 to about 40.

10. A color photographic material as defined by claim 1, wherein X is a halogen atom.

11. A color photographic material as defined by claim 1, wherein $R_3$ is selected from the group consisting of straight and branched chain alkyl and alkenyl groups of from 1 to about 20 carbon atoms.

12. A color photographic material as defined by claim 1, wherein $R_3$ comprises an aryl-substituted alkyl group.

13. A color photographic material as defined by claim 1, wherein $R_4$ and $R_5$ are individually selected from the group consisting of straight and branched chain, phenyl-substituted and unsubstituted alkyl groups of from 1 to about 20 carbon atoms.

14. A color photographic material as defined by claim 13, wherein $R_4$ and $R_5$ are the same.

15. A color photographic material as defined by claim 1, wherein $R_4$ and $R_5$ join to form a ring structure.

16. A color photographic material as defined by claim 1, wherein the total number of carbon atoms contained in $R_3$, $R_4$ and $R_5$ is from about 15 to about 30.

17. A color photographic material as defined by claim 1, wherein the composition further includes a third component comprising an organic solvent.

18. A photographic coupler composition, comprising (a) a pyrazolotriazole magenta dye-forming coupler, and (b) a carbonamide compound in an amount sufficient to improve the performance of the coupler compound, the pyrazolotriazole magenta dye-forming coupler being of the formula

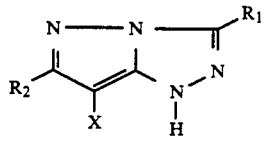

wherein $R_1$ and $R_2$ are individually selected from the group consisting of hydrogen, substituted and unsubstituted alkyl, substituted and unsubstituted phenyl, substituted and unsubstituted alkoxy, substituted and unsubstituted aryloxy, substituted and unsubstituted amino, substituted and unsubstituted aniline, substituted and unsubstituted acylamino, halogens and a group which links to a polymer, provided that the total number of carbon atoms contained in $R_1$ and $R_2$ is at least 10 if neither $R_1$ nor $R_2$ is a group which links to a polymer and provided that neither $R_1$ nor $R_2$ is an alkyl group directly substituted with a sulfonamido group or a sulfamoyl group and X is hydrogen or a coupling-off group selected from the group consisting of halogens, alkoxy, aryloxy, alkylthio, arylthio, acyloxy, sulfonamido, carbonamide, arylazo, nitrogen-containing heterocyclic and imido groups; and the carbonamide compound being of the formula $$R_3\overset{\overset{\displaystyle O}{\|}}{C}NR_4R_5$$

wherein $R_3$ is selected from the group consisting of straight and branched chain alkyl groups, alkenyl groups and alkylene groups; straight and branched chain alkyl groups, alkenyl groups and alkylene groups containing at least one substituent selected from the group consisting of alkoxy, aryloxy, aryl, alkoxycarbonyl, aryloxycarbonyl and acyloxy; a phenyl group; and a phenyl group containing at least one substituent selected from the group consisting of alkyl, alkoxy, aryloxy, aryl, alkoxycarbonyl, aryloxycarbonyl and acyloxy; and $R_4$ and $R_5$ are individually selected from the group consisting of straight and branched chain alkyl groups, alkenyl groups and alkylene groups; and straight and branched chain alkyl groups, alkenyl groups and alkylene groups containing at least one substituent selected from the group consisting of alkoxy, aryloxy, aryl, alkoxycarbonyl, aryloxycarbonyl and acyloxy; and wherein $R_3$, $R_4$ and $R_5$ combined contain at least 12 carbon atoms.

19. A color photographic material as defined by claim 1, wherein the supporting substrate is transparent.

* * * * *